US006793546B2

(12) United States Patent
Matsuda

(10) Patent No.: US 6,793,546 B2
(45) Date of Patent: Sep. 21, 2004

(54) SMALL WATERCRAFT

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/376,670

(22) Filed: Feb. 26, 2003

(65) Prior Publication Data

US 2003/0166363 A1 Sep. 4, 2003

(30) Foreign Application Priority Data

Mar. 4, 2002 (JP) ..... 2002-057569

(51) Int. Cl.[7] ..... B63H 21/10
(52) U.S. Cl. ..... 440/88 C
(58) Field of Search ..... 440/88 C

(56) References Cited

U.S. PATENT DOCUMENTS 4,759,316 A * 7/1988 Itakura ..... 123/41.08
5,788,547 A * 8/1998 Ozawa et al. ..... 440/89 R
2001/0039156 A1 * 11/2001 Sato ..... 440/88

FOREIGN PATENT DOCUMENTS

JP 2000-257423 9/2000

* cited by examiner

*Primary Examiner*—Stephen Avila
(74) *Attorney, Agent, or Firm*—Kolisch Hartwell, P.C.

(57) ABSTRACT

Disclosed is a small watercraft having an engine cooling system which can lessen a temperature distribution of an engine. The small watercraft comprises an engine for driving a propulsion unit of the watercraft, and the engine includes a first cooling passage formed inside a cylinder head of the engine, for cooling the cylinder head with a coolant flowing therethrough, and a second cooling passage formed inside a cylinder block of the engine, for cooling the cylinder block of the engine with a coolant flowing therethrough, the first and second cooling passages being independent of each other.

15 Claims, 7 Drawing Sheets

SMALL WATERCRAFT

BACKGROUND OF THE INVENTION

1. Field of the Invention

The present invention relates to a small watercraft such as a personal watercraft (PWC) which ejects water rearward and planes on a water surface as the resulting reaction. More particularly, the present invention relates to a cooling system of an engine or the like of the small watercraft.

2. Description of the Related Art

In recent years, so-called jet-propulsion personal watercraft, which are one type of small watercraft, have been widely used in leisure, sport, rescue activities, and the like. The jet-propulsion personal watercraft is configured to have a water jet pump that pressurizes and accelerates water sucked from a water intake generally provided on a bottom surface of a hull and ejects it rearward from an outlet port. Thereby, the personal watercraft is propelled.

In the jet-propulsion personal watercraft, a steering nozzle provided behind the outlet port of the water jet pump is swung either to the right or to the left by operating a bar-type steering handle to the right or to the left, to change the ejection direction of the water to the right or to the left, thereby turning the watercraft to the right or to the left.

In propulsion engines of small watercraft, including the jet-propulsion personal watercraft, a temperature and temperature distribution of various portions of the engine vary. This causes deformation of the engine and thereby degrades engine performance, or the like. Due to deformation of the engine, a clearance between an inner wall of a cylinder and a piston varies and friction between them thereby increases. In addition, a gasoline adhering to the inner wall of the cylinder without being vaporized moves into a crankcase and reduces the concentration of oil in the crankcase. In particular, in the case of an engine designed to minimize clearance between the piston and the cylinder for the purpose of reducing lubricating oil consumption or a piston lap noise, the increase in friction is problematic.

SUMMARY OF THE INVENTION

The present invention addresses the above-described condition, and an object of the present invention is to provide a small watercraft having an engine cooling system which can lessen a temperature distribution of an engine.

According to the present invention, there is provided a small watercraft comprising an engine for driving a propulsion unit of the watercraft, the engine including a first cooling passage formed inside a cylinder head of the engine, for cooling the cylinder head with a coolant flowing therethrough; and a second cooling passage formed inside a cylinder block of the engine, for cooling the cylinder block of the engine with a coolant flowing therethrough, the first and second cooling passages being independent of each other.

In accordance with the small watercraft having the above-described engine cooling system, since the coolant is independently supplied to the first cooling passage for supplying the coolant to the cylinder head of the engine and to the second cooling passage for supplying the coolant to the cylinder block of the engine, a large amount of coolant can be supplied to the cylinder head that generates more heat and a small amount of coolant can be supplied to the cylinder block that generates less heat. In addition, a low-temperature coolant can be supplied to the cylinder head and a coolant which has been used for cooling another component and has a temperature higher than that of the coolant of the first cooling passage can be supplied to the cylinder block. This allows a temperature distribution of the cylinder head and the cylinder block of the engine to be made uniform.

Preferably, the amount of the coolant flowing through the first cooling passage may be more than the amount flowing through the second cooling passage. This allows a temperature distribution in the engine to be made uniform.

Preferably, the small watercraft may further comprise a first cooling water supply pipe for supplying the coolant to the first cooling passage; and a second cooling water supply pipe for supplying the coolant to the second cooling passage.

Preferably, a flow cross-sectional area of the second cooling water supply pipe may be smaller than a flow cross-sectional area of the first cooling water supply pipe. In this structure, the amount of the coolant to be supplied to the cylinder block of the engine is less than the amount of the coolant to be supplied to the cylinder head, regardless of the amount of the coolant supplied to the cylinder head. This allows a temperature distribution in the engine to be made uniform. Because of the lesser amount of coolant, the cylinder block of the engine smoothly and quickly increases its temperature during the start of the engine. As a result, a clearance between an inner wall of the cylinder and a piston is rendered in a proper condition in a short time when the engine is starting.

Preferably, the flow cross-sectional area of the second cooling water supply pipe may be half as small as the flow cross-sectional area of the first cooling water supply pipe.

Preferably, the small watercraft may further comprise an exhaust pipe attached to an exhaust port of the engine, the exhaust pipe having a water jacket through which the coolant is supplied to the second cooling passage. Thereby, the coolant, which has passed through the exhaust pipe and has an increased temperature higher than a temperature of the coolant supplied to the cylinder head, is supplied to the cylinder block, and the temperature distribution of the engine can be made uniform.

In this structure, preferably, the coolant may be supplied to the first cooling passage through a first cooling water supply pipe and the coolant may be supplied to the second cooling passage through a second cooling water supply pipe connected to the water jacket of the exhaust pipe, wherein a flow cross-sectional area of the first cooling water supply pipe may be substantially equal to a flow cross-sectional area of the second cooling water supply pipe.

Preferably, water outside the watercraft may be supplied to the first and second cooling passages as the coolant. Since plenty of low-temperature water is supplied as the coolant, the small watercraft can have a sufficient cooling capability while in an operating state with a large load.

Preferably, the first cooling passage and a first cooling water supply pipe may form a first closed loop within which the coolant circulates, and the second cooling passage and a second cooling water supply pipe may form a second closed loop within which the coolant circulates. This structure prevents entry of unwanted substances into the first and second cooling passages.

In this structure, preferably, a flow cross-sectional area of the second cooling water supply pipe may be smaller than a flow cross-sectional area of the first cooling water supply pipe. The amount of the coolant to be supplied to the cylinder block of the engine that generates less heat is less than the amount of the coolant to be supplied to the cylinder head regardless of the amount of coolant supplied to the cylinder head. This allows the temperature distribution in the engine to be made uniform.

Preferably, the flow cross-sectional area of the second cooling water supply pipe may be substantially half as small as the flow cross-sectional area of the first cooling water supply pipe.

Preferably, the small watercraft may further comprise a cooler provided in the first and second closed loops, for cooling the coolant flowing within the first and second closed loops, the cooler being adapted to cool the coolant flowing within the closed loops with water drawn from outside the watercraft to the cooler. Thereby, effective indirect cooling of the engine is achieved with a simple structure.

The above and further objects and features of the invention will be more fully be apparent from the following detailed description with the accompanying drawings.

DETAILED DESCRIPTION OF THE PREFERRED EMBODIMENTS

Hereinafter, a preferred embodiment of a personal watercraft, which is one type of small watercraft of the present invention, will be described with reference to the accompanying drawings.

Figure 8:
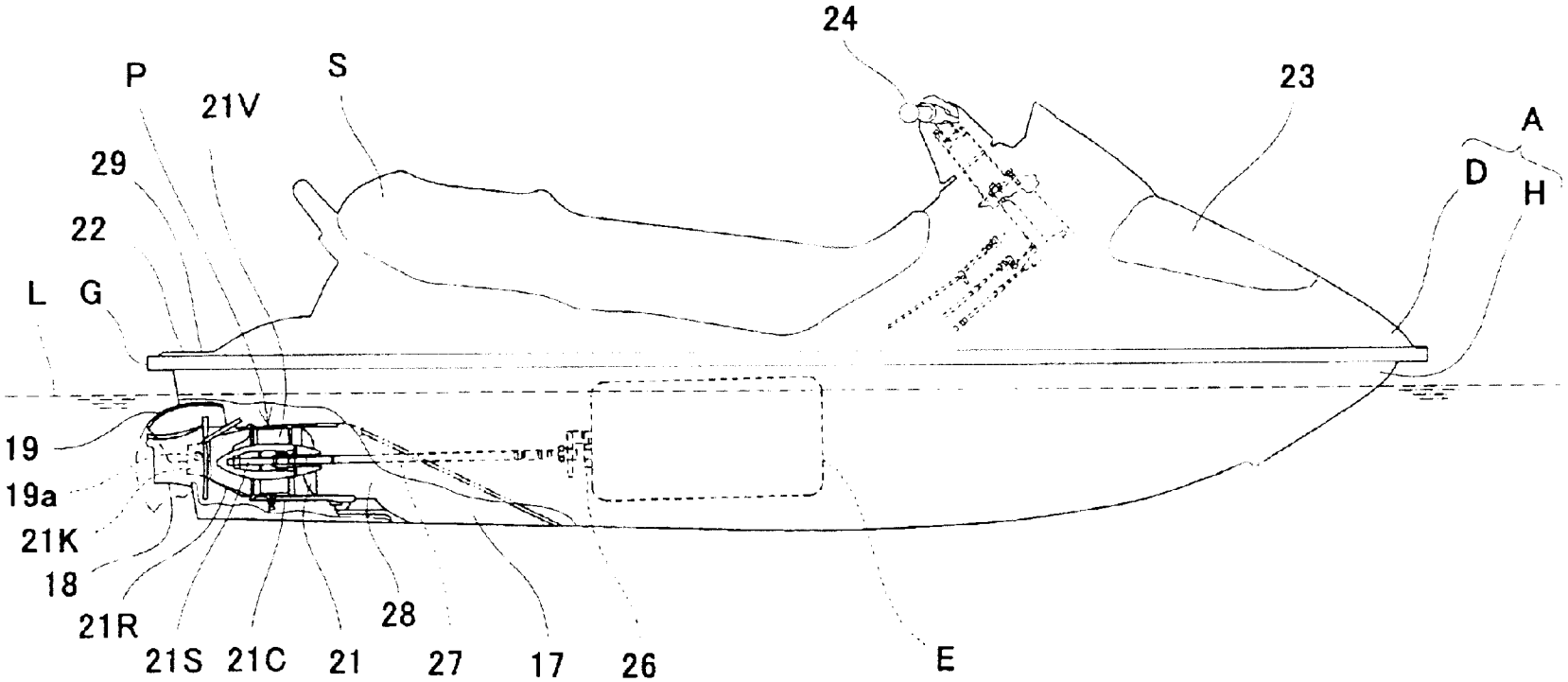
FIG. 8 is a side view showing a jet-propulsion small watercraft in which the engine is mounted.
Figure 9:
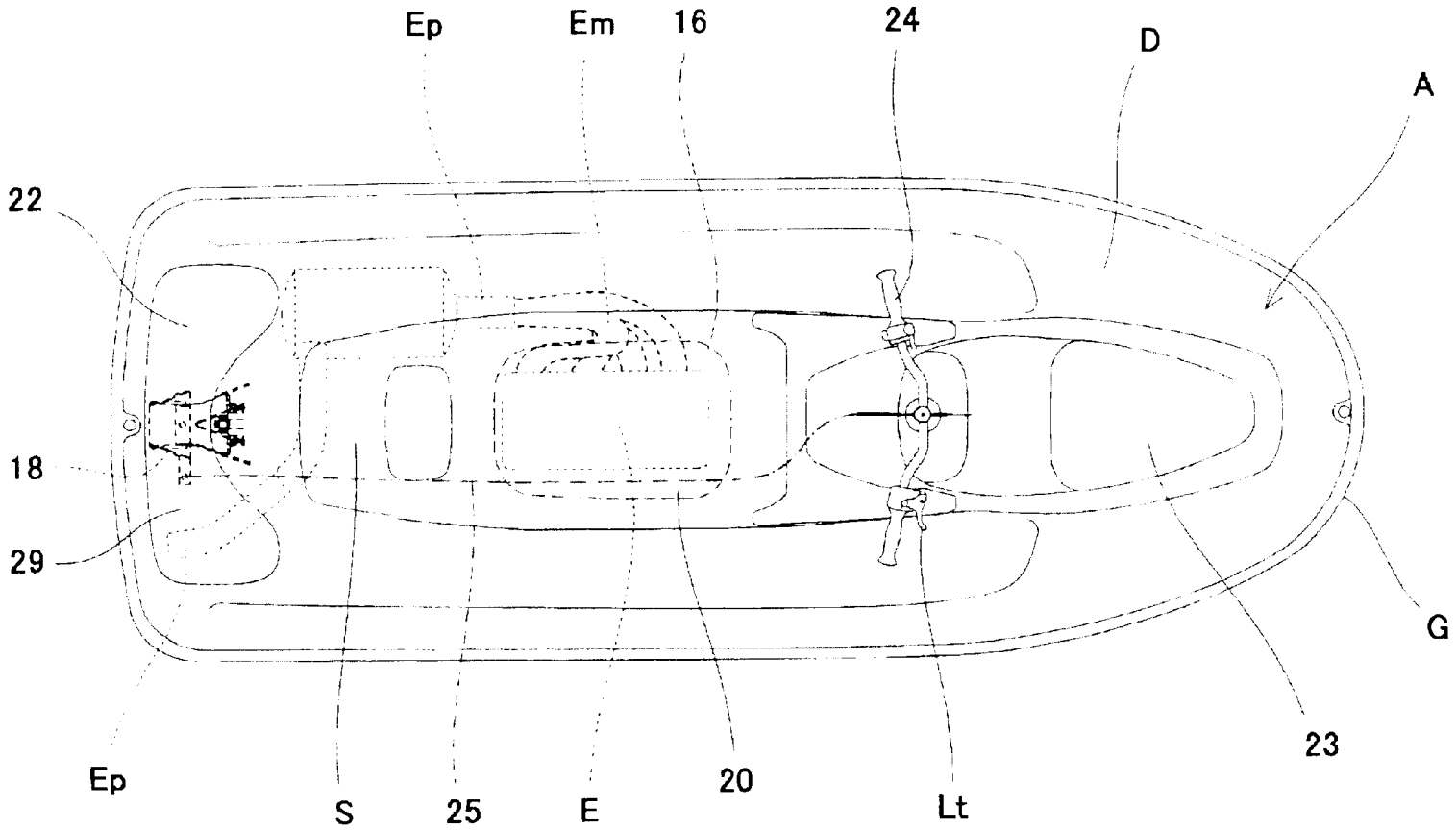
FIG. 9 is a plan view showing the small watercraft in FIG. 8.

Referring now to FIGS. 8 and 9, a body A of the jet-propulsion small watercraft comprises a hull H and a deck D covering the hull H from above. A line at which the hull H and the deck D are connected over the entire perimeter thereof is called a gunnel line G. In FIG. 8, L denotes a waterline.

As shown in FIG. 9, an opening 16, which has a substantially rectangular shape seen from above, is formed at a relatively rear section of the deck D over an upper surface of the body A such that it extends in the longitudinal direction of the body A, and a straddle-type seat S is provided over the opening 16.

An engine E is disposed in a chamber (engine room) 20 surrounded by the hull H and the deck D below the seat S and having a convex shape in a cross section of the body A such that cylinders extend upwardly.

The engine E has multiple cylinders (e.g., four cylinders) and is a four-cycle engine. As shown in FIG. 8, the engine E is mounted such that a crankshaft 26 extends along the longitudinal direction of the body A. An output end of the crankshaft 26 is rotatably coupled integrally with a pump shaft 21S of the water jet pump P through a propeller shaft 27. An impeller 21 is attached on the pump shaft 21S of the water jet pump P. The impeller 21 is covered with a pump casing 21C on the outer periphery thereof. A water intake 17 is provided on a bottom of the hull H. The water is sucked and taken in from the water intake 17 and supplied to the water jet pump P through a water intake passage 28. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining a propulsion force.

FIG. 8, 21V denotes fairing vanes for fairing a water flow inside the water jet pump P. In FIGS. 8 and 9, 24 denotes a bar-type steering handle. By operating the steering handle 24 to the right or to the left, the steering nozzle 18 provided behind the pump nozzle 21R swings to the right or to the left through a wire cable 25 indicated by a dashed line in FIG. 9. Thereby, the watercraft can be turned to any desired direction while the water jet pump P is generating a propulsion force.

As shown in FIG. 8, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward, and as the resulting reaction, the personal watercraft moves rearward.

As shown in FIGS. 8 and 9, a rear deck 22 formed at a stern part of the watercraft is provided with an operable hatch cover 29. A rear compartment with a small capacity is provided under the hatch cover 29. A front hatch cover 23 is provided on a fore part of the watercraft. A front compartment (not shown) is provided under the front hatch cover 23 for storing equipment and the like. As shown in FIG. 9, a throttle lever Lt is provided at an end portion of the steering handle 24, for adjusting an engine speed. An exhaust pipe Ep discharges an exhaust gas from an exhaust manifold Em mounted to the engine E outside the watercraft.

First Embodiment

Figure 1:
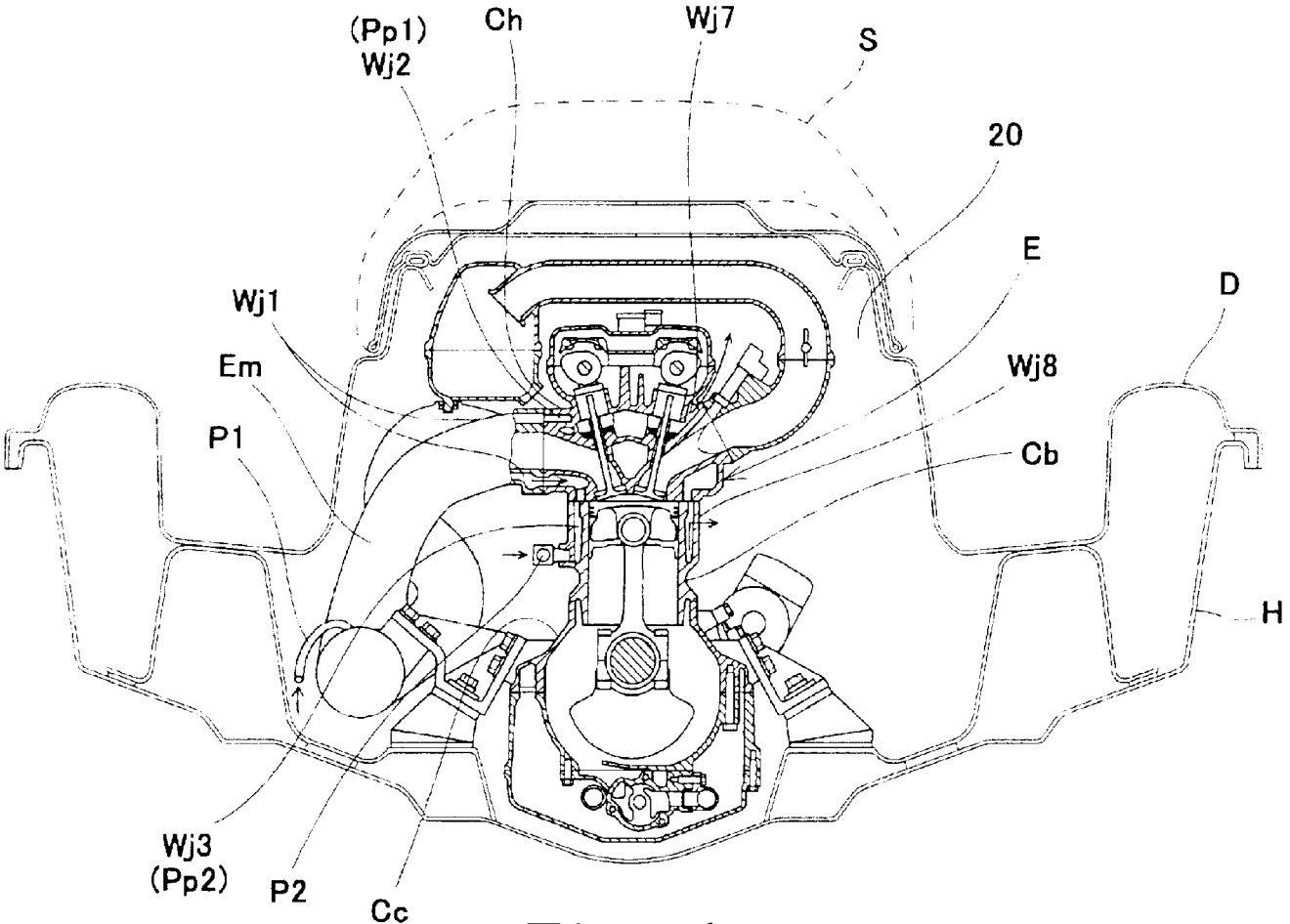
FIG. 1 is a transverse sectional view showing a body of a personal watercraft (small watercraft) according to a first embodiment of the present invention, and an engine mounted inside the body.
Figure 2:
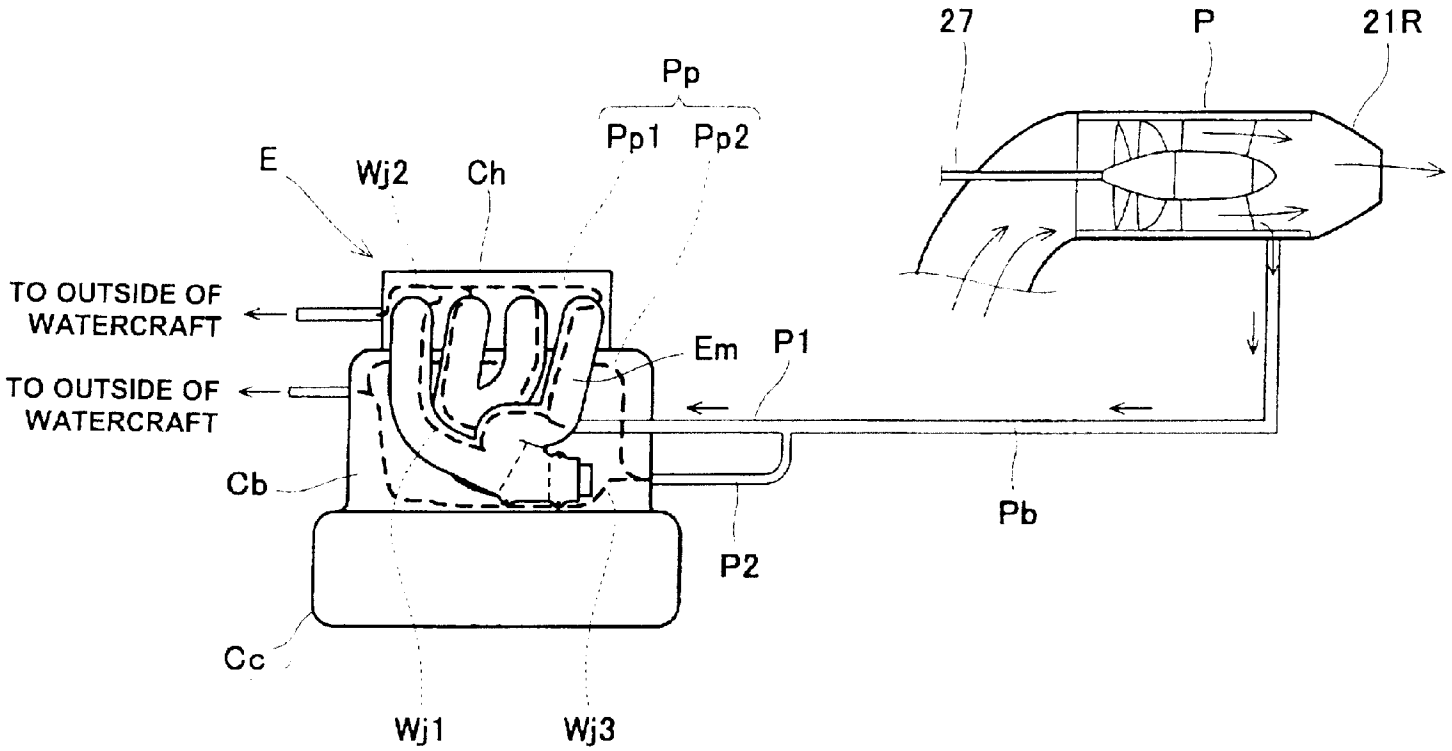
FIG. 2 is a view schematically showing an engine cooling system of a small watercraft in FIG. 1.

The small watercraft (personal watercraft) according to a first embodiment of the present invention has an engine cooling system shown in FIGS. 1 and 2. As shown in FIG. 2, a cooling passage Pp inside the engine E is comprised of a first cooling passage Pp1 for cooling a cylinder head Ch of the engine E with cooling water, and a second cooling passage Pp2 for supplying the cooling water to a cylinder block Cb of the engine E. The first and second cooling passages Pp1 and Pp2 are independent of each other. A flow cross-sectional area of the second cooling passage Pp2 is smaller than a flow cross-sectional area of the first cooling passage Pp1. Specifically, the flow cross-sectional area of the second cooling passage Pp2 is substantially half as small as the flow cross-sectional area of the first cooling passage Pp1. More specifically, a portion of the second cooling passage Pp2 with the smallest flow cross-sectional area is substantially half as small as the smallest flow cross-sectional area of the first cooling passage Pp1. This structure is achieved easily by forming the portion (restricting portion) with the smallest cross-sectional area at an entrance or exit of the first cooling passage Pp1 and/or at an entrance or exit of the second cooling passage Pp2.

As shown in FIG. 2, an inside of the cylinder head Ch of the engine E is cooled by cooling water flowing through the first cooling passage Pp1 constituting a water jacket Wj2 of the cylinder head Ch. In this structure, low-temperature water outside the watercraft is taken in as the cooling water by the water jet pump P and supplied to the first cooling passage Pp1 through a cooling water supply pipe (first cooling water supply pipe) P1 and a cooling passage inside an exhaust manifold Em. The cooling water cools the exhaust manifold Em and the cylinder head Ch and is thereafter discharged outside the watercraft.

As shown in FIG. 2, an inside of the cylinder block Cb of the engine E is cooled by cooling water flowing through the second cooling passage Pp2 constituting a water jacket Wj3 of the cylinder block Cb. In this structure, low-temperature water outside the watercraft is taken in as the cooling water by the water jet pump P and is delivered to an entrance formed in a side portion of the cylinder block Cb through a cooling water branch pipe (second cooling water supply pipe) P2 and supplied to the second cooling passage Pp2. The cooling water cools the cylinder block Cb and is thereafter discharged outside the watercraft.

A base end of the cooling water supply pipe P1 and a base end of the cooling water branch pipe P2 are connected to a tip end of a cooling water supply main pipe Pb. A base end of the cooling water supply main pipe Pb is connected to a positive-pressure region inside the water jet pump P to allow the water pressurized inside the water jet pump P to be drawn to the cooling water supply main pipe Pb as the cooling water.

In the personal watercraft, the cooling water branch pipe P2 has a flow cross-sectional area smaller than, for example, substantially half as small as a flow cross-sectional area of the cooling water supply pipe P1. A flow cross-sectional area of the cooling water supply main pipe Pb is substantially equal to or more than a sum of the flow cross-sectional area of the cooling water supply pipe P1 and the flow cross-sectional area of the cooling water branch pipe P2.

The first cooling passage Pp1 will be described in conjunction with the engine E. As shown in FIG. 1, cooling water is delivered to an entrance of the water jacket Wj1 formed in the exhaust manifold Em through the cooling water supply pipe P1. The cooling water flows through the water jacket Wj1 to an entrance of a lower end portion of the water jacket Wj2 (first cooling passage Pp1) of the cylinder head Ch located at a top portion of the engine E. The cooling water then flows through the water jacket Wj2 and is discharged from an exit Wj7 of the water jacket Wj2 formed at an upper end portion of the cylinder head Ch outside the engine E.

The second cooling passage Pp2 will be described in conjunction with the engine E. As shown in FIG. 1, cooling water is supplied to an entrance at a center position in a vertical direction of the engine E; for example, at a center position of the cylinder block Cb, and flows through a water jacket Wj3 (second cooling passage Pp2) formed in the cylinder block Cb and is discharged from an exit Wj8 of the water jacket Wj3 formed at an upper end portion of the cylinder block Cb outside the engine E.

Typically, the cooling water discharged outside the engine E is discharged outside the watercraft through an exhaust pipe (not shown). The cooling water is discharged outside the watercraft, for example, through a cooling water discharge pipe (not shown) with its tip end connected to a negative-pressure region inside the water jet pump P, and then through the water jet pump P.

In the small watercraft (personal watercraft) having the above-described engine cooling system, the low-temperature cooling water supplied by the water jet pump P flows to the entrance of the water jacket Wj1 formed in the exhaust manifold Em through the cooling water supply main pipe Pb and the cooling water supply pipe P1, and then flows through the water jacket Wj1, while cooling the exhaust manifold Em and an exhaust gas flowing through an inside thereof. The cooling water that has cooled the water jacket Wj1 of the exhaust manifold Em, is delivered to the entrance of the lower end portion of the water jacket Wj2 (first cooling passage Pp1) formed in the cylinder head Ch and flows through the water jacket Wj2 while cooling the cylinder head Ch at, for example, a wall face at an upper end portion of a combustion chamber in the vicinity of air-intake and exhaust valves. The cooling water that has cooled the cylinder head Ch, is discharged outside the engine E from the exit Wj7 of the water jacket Wj2 formed at the upper end portion of the cylinder head Ch.

The cooling water supplied through the cooling water supply main pipe Pb (see FIG. 2), is also delivered to the entrance at the center position of the cylinder block Cb through the cooling water branch pipe P2 as shown in FIGS. 1 and 2 and flows through the water jacket Wj3 (second cooling passage Pp2) formed in the cylinder block Cb while cooling the cylinder block Cb. Since the flow cross-sectional area of the water jacket Wj3 of the cylinder block Cb as the second cooling passage Pp2 is smaller than the flow cross-sectional area of the water jacket Wj2 of the cylinder head Ch as the first cooling passage Pp1, the amount of the cooling water flowing through the water jacket Wj3 is less than the amount of the cooling water flowing through the water jacket Wj2. Therefore, the cylinder block Cb is not cooled so greatly as is the cylinder head Ch.

In this engine cooling system, the cylinder head Ch and the exhaust manifold Em with high temperatures are greatly cooled by the large amount of cooling water flowing through the water jackets Wj1, Wj2 formed inside thereof, while the cylinder block Cb with a lower temperature is cooled by the small amount of water flowing through the water jacket Wj3 not cooled as greatly as the cylinder head Ch and the exhaust manifold Em.

In this engine cooling system, the various components (cylinder head Ch, exhaust manifold Em, and cylinder block Cb) of the engine E are cooled to have substantially uniform temperature. This makes the temperature and temperature distribution of the components of the engine E uniform, and thereby lessens deformation of the engine E due to variation in the temperature distribution. In FIGS. 1 and 2, Cc denotes a crankcase of the engine E.

Second Embodiment

Figure 3:
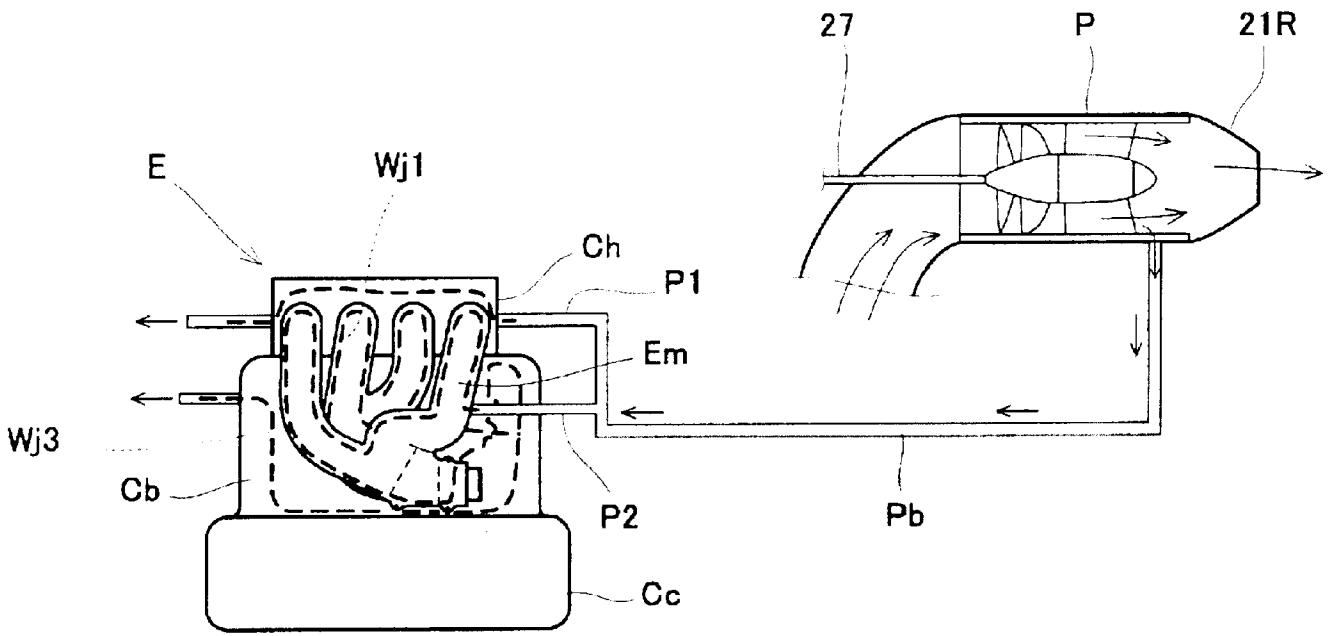
FIG. 3 is a view schematically showing an engine cooling system of a small watercraft according to a second embodiment of the present invention.

In an engine cooling system according to a second embodiment in FIG. 3, the cooling water supplied to the exhaust manifold Em from the cooling water branch pipe P2 is supplied to the water jacket Wj3 inside the cylinder block Cb and the cooling water from the cooling water supply pipe P1 is directly supplied to the cylinder head Ch of the engine E.

In this engine cooling system, the flow cross-sectional area of the cooling water branch pipe P2 may be larger than a half of the flow cross-sectional area of the cooling water supply pipe P1 and not substantially larger than the flow cross-sectional area of the cooling water supply pipe P1. The cooling water which has flowed through the water jacket Wj1 of the exhaust manifold Em, and thereby has increased its temperature, is supplied to the cylinder block Cb, while the cooling water with a temperature lower than that supplied to the cylinder block Cb is directly supplied from the cooling water supply pipe P1 to the cylinder head Ch. In particular, when the engine starts, the cylinder head Ch and the exhaust manifold Em rapidly increase their respective temperatures due to an exhaust gas, while the cylinder block Cb does not increase its temperature as quickly as the cylinder head Ch and the exhaust manifold Em. The cooling water that has passed through the water jacket Wj1 of the exhaust manifold E heated by the exhaust gas, and which thereby has been warmed, is supplied to the cylinder block Cb, while the cooling water with a low temperature is supplied to the cylinder head Ch. Consequently, during the start of the engine E, the temperature distribution of the various components of the engine E is made uniform.

In this engine cooling system, further, intake air of the engine flowing through the inside of the cylinder head Ch is cooled by the low-temperature cooling water more greatly than is the intake air in the engine cooling system in the first embodiment. This is advantageous in that a filling percentage of an air-fuel mixture fed into the combustion chamber is increased. In FIG. 3, Pb denotes a cooling water supply main pipe, Cc denotes a crankcase, 27 denotes a propeller shaft, and 21R denotes a pump nozzle.

Third Embodiment

Figure 4:
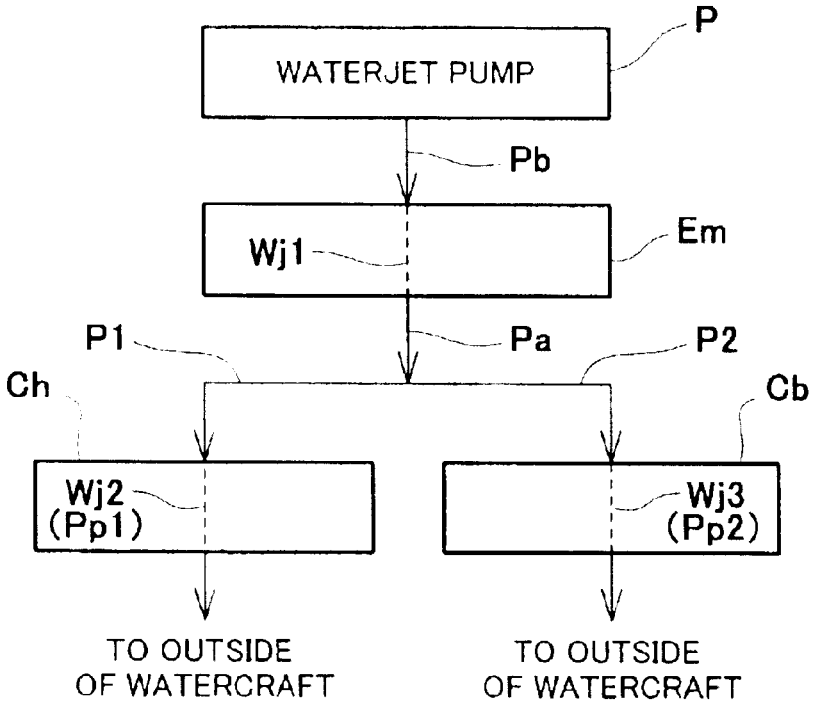
FIG. 4 is a view schematically showing an engine cooling system of a small watercraft according to a third embodiment of the present invention.

As schematically shown in FIG. 4, water is supplied as cooling water from the water jet pump P to the water jacket Wj1 of the exhaust manifold Em through the cooling water supply main pipe Pb. Then, the cooling water flows from the water jacket Wj1 of the exhaust manifold Em through a cooling water supply pipe Pa and branches into cooling water, which is supplied to the water jacket Wj2 as the first cooling passage Pp1 of the cylinder head Ch through the cooling water supply pipe P1 and cooling water, which is supplied to the water jacket Wj3 as the second cooling passage Pp2 of the cylinder block Cb through the cooling water branch pipe P2. In this system, as in the first embodiment, preferably, the flow cross-sectional area of the cooling water branch pipe P2 is smaller than, for example, substantially half as small as the flow cross-sectional area of the cooling water supply pipe P1.

Fourth Embodiment

Figure 5:
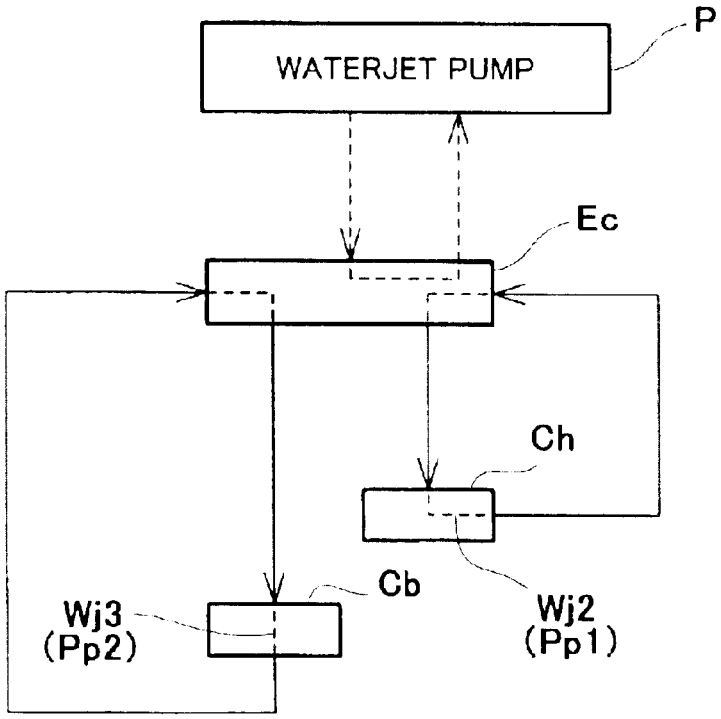
FIG. 5 is a view schematically showing an engine cooling system of a small watercraft according to a fourth embodiment of the present invention.

In an engine cooling system according to a fourth embodiment of the present invention, as shown in FIG. 5, the water jacket Wj2 as the first cooling passage Pp1 of the cylinder head Ch and the water jacket Wj3 as the second cooling passage Pp2 of the cylinder block Cb respectively form independent closed loops, within which a coolant (water or a cooling medium such as an oil) is circulated and a common cooler Ec or independent coolers (not shown) are provided. The cooling water from the water jet pump P may be led into an inside of the cooler Ec to cool the coolant flowing through the inside of the cooler Ec.

The same function and effects as provided by the above-described embodiments are obtained by setting the flow cross-sectional area of the second cooling passage Pp2 smaller than the flow cross-sectional area of the first cooling passage Pp1.

Fifth Embodiment (Modification of Fourth Embodiment)

Figure 6:
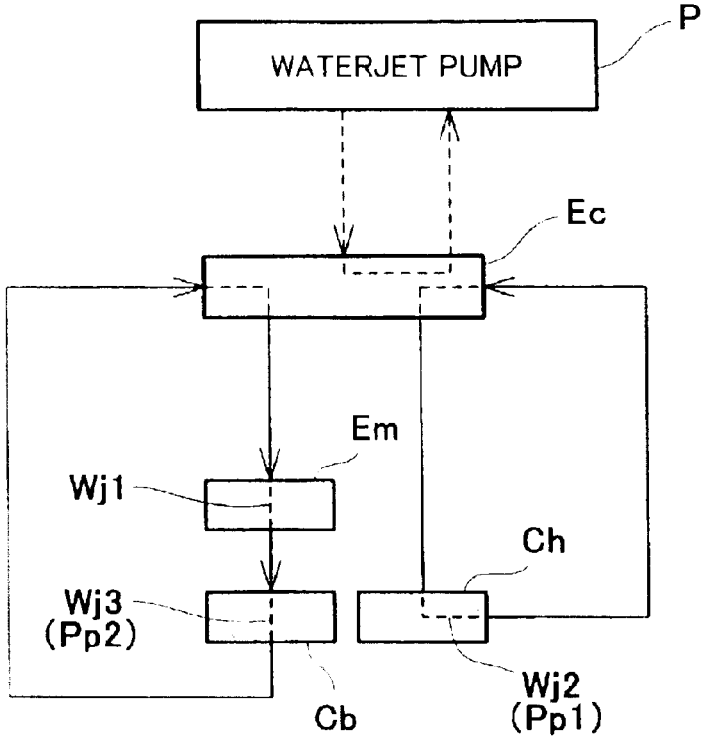
FIG. 6 is a view schematically showing an engine cooling system of a small watercraft according to a fifth embodiment of the present invention.

In an engine cooling system according to a fifth embodiment of the present invention, as shown in FIG. 6, the coolant is supplied from the cooler Ec to the water jacket Wj3 as the second cooling passage Pp2 of the cylinder block Cb through the water jacket Wj1 of the exhaust manifold Em, while the coolant is directly supplied from the cooler Ec to the water jacket Wj2 as the first cooling passage Pp1 of the cylinder head Ch. In this engine cooling system, in addition to the function and effects provided by the closed loop, the coolant warmed by the exhaust manifold Em is supplied to the cylinder block Cb and the lower-temperature coolant is directly led from the cooler Ec to the cylinder head Ch, as in the second embodiment. In the fifth embodiment, the same components as those in the second and fourth embodiments are identified by the same reference numerals.

Sixth Embodiment (Modification of Fourth Embodiment)

Figure 7:
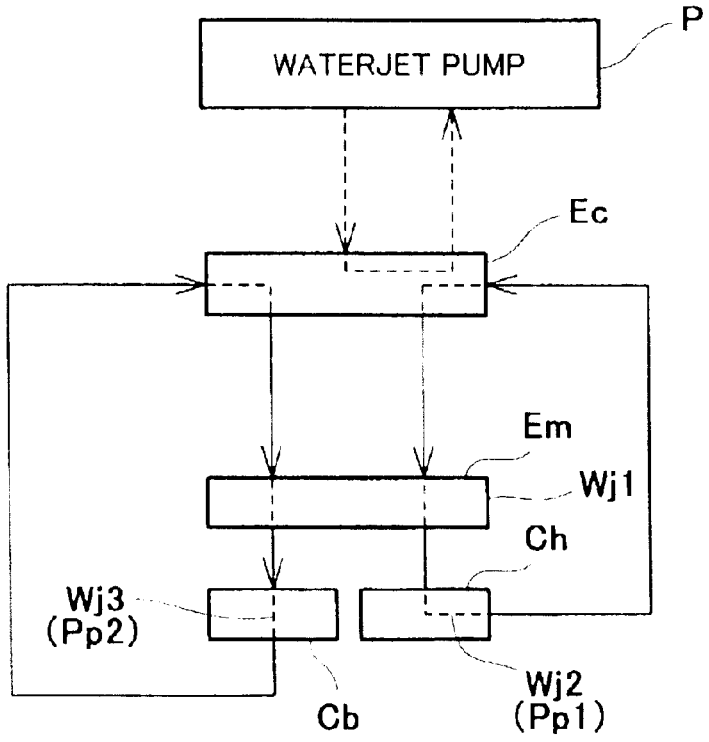
FIG. 7 is a view schematically showing an engine cooling system of a small watercraft according to a sixth embodiment of the present invention.

In an engine cooling system according to a sixth embodiment of the present invention, as shown in FIG. 7, the coolant is independently supplied from the cooler Ec to the water jacket Wj2 as the first cooling passage Pp1 of the cylinder head Ch and to the water jacket Wj3 as the second cooling passage Pp2 of the cylinder block Cb, through the water jacket Wj1 of the exhaust manifold Em. In this engine cooling system, in addition to the function and effects provided by the closed loop, the function and effects provided by the third embodiment are obtained. In the sixth embodiment, the same components as those in the third and fourth embodiments are identified by the same reference numerals.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A small watercraft comprising:

an engine for driving a propulsion unit of the watercraft, the engine including:

a first cooling passage formed inside a cylinder head of the engine, for cooling the cylinder head with a coolant flowing therethrough; and a second cooling passage formed inside a cylinder block of the engine, for cooling the cylinder block of the engine with a coolant flowing therethrough, the first and second cooling passages being independent of each other, wherein an amount of the coolant flowing through the first cooling passage is more than an amount of the coolant flowing through the second cooling passage, and water outside the watercraft is supplied to the first and second cooling passages as the coolant.

2. The small watercraft according to claim 1, further comprising:

a first cooling water supply pipe for supplying the coolant to the first cooling passage; and a second cooling water supply pipe for supplying the coolant to the second cooling passage.

3. The small watercraft according to claim 2, wherein a flow cross-sectional area of the second cooling water supply pipe is smaller than a flow cross-sectional area of the first cooling water supply pipe.

4. The small watercraft according to claim 3, wherein the flow cross-sectional area of the second cooling water supply pipe is substantially half as small as the flow cross-sectional area of the first cooling water supply pipe.

5. The small watercraft according to claim 1, wherein a smallest cross-sectional area of the first cooling passage is larger than a smallest cross-sectional area of the second cooling passage.

6. The small watercraft according to claim 5, wherein the smallest cross-sectional area of the second cooling passage is formed at an entrance portion of the second cooling passage.

7. The small watercraft according to claim 5, wherein the smallest cross-sectional area of the second cooling passage is formed at an exit portion of the second cooling passage.

8. The small watercraft according to claim 1, wherein at least one of said first and second cooling passages discharge water outside the watercraft.

9. The small watercraft according to claim 8, wherein both said first and second cooling passages separately discharge water outside the watercraft.

10. A small watercraft comprising:

an engine for driving a propulsion unit of the watercraft, the engine including:

a first cooling passage formed inside a cylinder head of the engine, for cooling the cylinder head with a coolant flowing therethrough; and a second cooling passage formed inside a cylinder block of the engine, for cooling the cylinder block of the engine with a coolant flowing therethrough, the first and second cooling passages being independent of each other; and an exhaust pipe attached to an exhaust port of the engine, the exhaust pipe having a water jacket through which the coolant is supplied to the second cooling passage.

11. The small watercraft according to claim 10, wherein the coolant is supplied to the first cooling passage through a first cooling water supply pipe, and the coolant is supplied to the second cooling passage through a second cooling water supply pipe connected to the water jacket of the exhaust pipe, and wherein a flow cross-sectional area of the first cooling water supply pipe is substantially equal to a flow cross-sectional area of the second cooling water supply pipe.

12. The small watercraft according to claim 10, wherein an amount of the coolant flowing through the first cooling passage is more than an amount of the coolant flowing through the second cooling passage.

13. A small watercraft comprising:

an engine for driving a propulsion unit of the watercraft, the engine including:

a first cooling passage formed inside a cylinder head of the engine, for cooling the cylinder head with a coolant flowing therethrough; and a second cooling passage formed inside a cylinder block of the engine, for cooling the cylinder block of the engine with a coolant flowing therethrough, the first and second cooling passages being independent of each other, wherein an amount of the coolant flowing through the first cooling passage is more than an amount of the coolant flowing through the second cooling passage, wherein the first cooling passage and a first cooling water supply pipe form a first closed loop within which the coolant circulates, and the second cooling passage and a second cooling water supply pine form a second closed loon within which the coolant circulates; and a cooler provided in the first and second closed loops, for cooling the coolant flowing within the first and second closed loops, the cooler being adapted to cool the coolant flowing within the closed loops with water drawn from outside the watercraft to the cooler.

14. The small watercraft according to claim 13, wherein a flow cross-sectional area of the second cooling water supply pipe is smaller than a flow cross-sectional area of the first cooling water supply pipe.

15. The small watercraft according to claim 13, wherein the flow cross-sectional area of the second cooling water supply pipe is substantially half as small as the flow cross-sectional area of the first cooling water supply pipe.

* * * * *